US006293994B1

(12) United States Patent
Field et al.

(10) Patent No.: US 6,293,994 B1
(45) Date of Patent: Sep. 25, 2001

(54) MINERAL PELLETISATION

(75) Inventors: John Rodney Field, Halifax; Paul Stocks, Bradford, both of (GB)

(73) Assignee: Ciba Specialty Chemicals Water Treatments Ltd., Bradford (GB)

( * ) Notice: Subject to any disclaimer, the term of this patent is extended or adjusted under 35 U.S.C. 154(b) by 0 days.

(21) Appl. No.: 09/508,148

(22) PCT Filed: Sep. 21, 1998

(86) PCT No.: PCT/GB98/02856

§ 371 Date: Mar. 7, 2000

§ 102(e) Date: Mar. 7, 2000

(87) PCT Pub. No.: WO99/18247

PCT Pub. Date: Apr. 15, 1999

(30) Foreign Application Priority Data

Oct. 3, 1997 (GB) ..... 9721085

(51) Int. Cl.[7] ..... C22B 1/244

(52) U.S. Cl. ..... 75/772; 75/773; 75/321; 75/322

(58) Field of Search ..... 75/772, 773, 321, 75/322

(56) References Cited

U.S. PATENT DOCUMENTS 4,684,549 * 8/1987 Allen et al. ..... 427/221
4,728,537 * 3/1988 Allen et al. ..... 427/221
5,002,607 * 3/1991 Flesher et al. ..... 75/772

FOREIGN PATENT DOCUMENTS

| | | |
|---|---|---|
| 225 171 | 6/1987 | (EP) . |
| 288 150 | 10/1988 | (EP) . |
| 376 713 | 7/1990 | (EP) . |
| 413 592 | 2/1991 | (EP) . |
| 413 603 | 2/1991 | (EP) . |
| 93 03189 | 2/1993 | (WO) . |
| 93 03190 | 2/1993 | (WO) . |

* cited by examiner

*Primary Examiner*—Roy King
*Assistant Examiner*—Tima McGuthry-Banks
(74) *Attorney, Agent, or Firm*—David R. Crichton

(57) ABSTRACT

The present invention is directed to a process of making fired mineral pellets by mixing particulate mineral material with moisture and binder comprising substantially water soluble organic polymer to form a moist pelletizable mix, pelletizing the moist mix by a tumbling process to form green pellets and firing the green pellets, characterized in that the binder comprises alkali metal silicate in a dry weight amount which is either (a) above 0.13% based on moist mix or (b) above 0.08% based on moist mix and at least three times the dry weight of substantially water soluble organic polymer.

13 Claims, No Drawings

MINERAL PELLETISATION

This invention relates to the production of pellets of iron ore and other minerals, and to the novel pellets themselves.

It is standard practice to make fired mineral pellets by a process comprising mixing particulate mineral material with moisture and binder to form a moist pelletisable mix, pelletising the moist mix by a tumbling process to form green pellets and firing the green pellets to form the fired mineral pellets.

Traditionally the binder was bentonite. This gave green pellets of adequate strength and fired pellets having good strength and other properties, but which were accompanied by certain disadvantages. Accordingly there has been considerable interest in the use of binders which comprise substantially water soluble organic polymer, as partial or complete replacement for the bentonite. Polymers which have been described for this purpose include natural polymers such as starches, celluloses and gums, and synthetic polymers such as anionic acrylamides as described in, for instance, EP-A-225,171 and WO93/03190.

When a synthetic polymer is being used, it is often accompanied by inorganic or organic monomeric electrolytes or other additives, of which sodium carbonate and sodium silicate are generally preferred. For instance such additives are described in EP-A-225,171 as being used in an amount which can be up to 150% based on the soluble polymer or below 0.1% and usually below 0.02% based on the ore. In practice the materials that have been most widely used are mixtures of about 1 to 2 parts by weight substantially water soluble polymer and 1 part by weight sodium carbonate.

The typical dosage of substantially water soluble polymeric binders is generally in the range 0.01 to 0.1% but amounts of up to 0.2% have been mentioned. This is much less than the typical dosage of bentonite, which is typically around 0.5 to 1%, often about 0.7%, based on the moist mix.

It is desirable that the pellets should have a narrow particle size distribution and should acquire a suitable size rapidly by conventional pelletising techniques. A difficulty with existing binders based on substantially water soluble organic polymers is that the size distribution is often rather wide. Another problem is that the rate of pellet growth and/or the final pellet size often tends to be less than would be desirable.

The wide size distribution which is often obtained is broader than is desired (even, sometimes, when using bentonite as binder) is undesirable because of the inconvenience of having oversize and undersize pellets and the need, in some instances, to crush and/or recycle pellets of the wrong size. Accordingly one object of the invention is to modify the binder in such a way as to improve pellet growth as regards size distribution, and/or as regards rate of growth and/or final size. Another object is to provide an improved combination of dry strength, wet strength and drop number and, generally, improved properties in the final pellets.

According to the invention, we use a binder which comprises the substantially water soluble organic polymer and also an alkali metal silicate and we use this alkali metal silicate in a dry weight amount which is considerably above the amounts ever used or disclosed in practice as additives for organic polymer binders, for instance as in EP 225,171.

One way of defining the amount of the alkali metal silicate is to say that the amount which is used is above 0.13% based on the weight of the moist mix. Another way of defining the amount of the alkali metal silicate is that it is above 0.08% based on the weight of the moist mix and is at least three times the weight (on a dry basis) of the substantially water soluble organic polymer.

Thus the invention includes processes in which the amount of alkali metal silicate is, for instance, 0.08 to 0.12%, for instance 0.1% or more, and in which it is at least three times the dry weight of the substantially water soluble organic polymer. Thus, in this embodiment, the amount of the alkali metal silicate is at least 300% based on the polymer, in contrast to the upper proposed amount of 150% in EP-A-225,171.

Generally, however, the amount of alkali metal silicate is above 0.13%, in contrast to the upper limit of 0.1% and the preferred upper limit of 0.02% proposed in EP-A-225,171. The amount of the alkali metal silicate is in practice usually always significantly above the amount of organic polymer and is usually at least two times and usually at least three times or more the dry weight of the organic polymer. Often it is at least four, and frequently at least six times the dry weight of the substantially water soluble polymer. It can be up to fifteen or twenty times, but usually there is no advantage in using an amount of the alkali metal compound which is greater than about ten times the dry weight of the substantially water soluble polymer.

The amount of the alkali metal silicate is usually at least 0.15% and preferably at least 0.18% by weight based on the weight of the moist mixture and generally is at least 0.2%. It can be up to 1% or even 2% but usually there is no advantage in using more than 0.7%, and 0.5% is often a convenient upper limit.

If inadequate alkali metal compound is used, there will be inadequate improvement in performance, for instance in pellet growth and/or in the properties of the green pellets or the fired pellets. Additionally, it seems that the alkali metal silicate contributes to the metallurgical properties in a manner somewhat similar to the manner in which bentonite contributes as a result of slag or other bonding during the firing process. It seems that the invention may surprisingly have resulted in achieving inorganic bonding mechanisms within the pellets somewhat similar in quality and quantity to those conventionally achieved using around 0.7% bentonite but without the accompanying disadvantages of bentonite.

The alkali metal silicate is usually a sodium silicate, but other alkali metal silicates can be used. The ratio $Na_2O:SiO_2$ can be anywhere in the normal range of 2:1 to 1:5. Accordingly, one preferred type of sodium silicate is sodium metasilicate. Another preferred type of silicate is the material commercially available under the name Waterglass.

Although Waterglass gives very good results, in some instances it is preferred to use a powdered sodium silicate, in which event sodium metasilicate or other powdered silicate, for instance having a ratio $Na_2O:Si_2$ 2:1 to 1:2.5 or 3 is often preferred. The powdered silicate should either be finely divided or should be in the form of aggregates which degrade during pelletisation to finely divided primary particles.

The substantially water soluble organic polymer can be added as a solution or as a substantially anhydrous emulsion of polymer particles dispersed in a water immiscible liquid or as a hydrous emulsion of polymer particles dispersed in water immiscible liquid. Preferably however the polymer is added as a powder. The powder may consist of primary particles having the desired particle size for use in the moist mix or it may consist of aggregates which disintegrate during admixture with the mineral particles to form the desired primary particle size. Generally the primary particle size is at least 90% by weight below 200 $\mu$m and often below 150 $\mu$m, but it is usually above 20 $\mu$m. Best results are often achieved when at least 90% by weight of the polymer particles are in the range 20 to 100 $\mu$m but a satisfactory product is 98% by weight below 200 $\mu$m and at least 50% by weight below 100 $\mu$m, and generally above 20 $\mu$m.

The amount of polymer must be sufficient for the green pellets to have suitable properties and in practice is usually typical of the amount of organic polymer which is conventionally used. Thus the amount is usually in the range 0.01 to 0.2%, usually 0.01 to 0.1%, by weight based on the moist mix. Generally the amount is in the range 0.01 or 0.02 up to 0.05%.

The polymer can be a natural polymer (by which we include modified natural polymers) such as cellulosic polymers, starch polymers and gums. Pelletisation binders based on such materials are known and can be used in the invention.

Preferably however the polymer is a synthetic polymer formed of water soluble ethylenically unsaturated monomer or monomer blend. The polymer can, with some mineral ores, be cationic, for instance when formed from a monomer blend containing cationic monomer such as dialkylaminoalkyl (meth)-acrylate or -acrylamide usually as quaternary ammonium or acid addition salt or diallyl diammonium chloride. Usually, however, the polymer is anionic as a result of having been formed from anionic monomer such as ethylenically unsaturated sulphonic acid or, more usually, carboxylic acid such as acrylic acid or methacrylic acid. The polymer may, instead, be non-ionic, for instance being a substantial homopolymer of acrylamide.

Preferably the polymer is a copolymer of acrylamide with anionic or cationic monomer, with preferred polymers being copolymers of 10 to 50% (often 15 to 30%) by weight sodium acrylate with the balance being acrylamide. Typically the polymer has intrinsic viscosity 3 to 16 dl/g, intrinsic viscosity being measured by suspended level viscometer in a 1N sodium chloride solution buffered to pH 7 at 25° C.

The polymer may be substantially linear so as to maximise solubility, as a result of being made solely from the defined monoethylenically unsaturated monomers. However it is often preferred that the polymer has some cross linking in an amount insufficient to significantly insolubilise the polymer. For instance the polymer may be made in the presence of 5 to 50 ppm cross linking agent. Suitable substantially water soluble polymers made in the presence of cross linking agent are described in more detail in WO93/03190 and reference should be made to that for further details of them.

Blends of synthetic and natural polymers may be used, for instance blends of guar gum and synthetic anionic polymer of the types discussed above.

The pelletisable mix must contain sufficient moisture to promote pelletisation without being so moist as to inhibit satisfactory results. The total moisture content of the moist mix is usually in the range 5 to 15% water based on the total mix (as measured by weighing the mix before and after heating to constant weight at 105° C.). Generally the amount of moisture is at least 8% but usually it is not more than 12%. The precise optimum in any particular process tends to vary according to the materials which are being used. If the initial ore is moist and/or if the alkali metal silicate is introduced as a solution (for instance Waterglass) and/or if the polymer is introduced as a solution or an aqueous emulsion in non-aqueous liquid, it is generally unnecessary to add separate water to the mix to obtain the desired moisture content, although this can be done if desired. Best results are usually obtained by relying on the moisture naturally present in the particulate mineral and then adding the polymer, and preferably also the silicate, as powder.

The binder can include minor amounts of any of the monomeric electrolytes or other additives conventionally included with organic polymers, such as any of the materials listed in EP-A-225,171 in the quantities proposed therein. When such additives include silicate then, for the purposes of the present specification, this silicate is considered as part of the alkali metal silicate in the binder. Thus the binder may include sodium carbonate in a small amount.

Preferred binders of the invention are novel and comprise 1 part of the substantially water soluble polymer, zero to 1.3 parts sodium carbonate and 2.5 to 15 parts, preferably 3 to 10 parts, sodium silicate (all parts being by weight).

The binder system may additionally contain insoluble cross linked polymer, as in EP 225,171.

The binder is generally wholly or substantially free of bentonite, for instance because the alkali metal compound is intended to give some or all of the effects of bentonite without needing to include bentonite in the mix. Accordingly the amount of bentonite which is added into the moist mix will always be much less than is conventional as a binder, and so is usually below 0.3% and preferably below 0.1% and most preferably below 0.05%, by weight of the moist mix. Generally no bentonite is added to the moist mix as binder. Generally the particulate mineral material which is used for forming the moist mix is substantially free of bentonite clays.

The particulate mineral which is used in the invention is usually a metal ore and is preferably iron ore.

The mineral particles from which the pellets are formed are usually at least 90% by weight and preferably at least 98% by weight below 500 $\mu$m and generally below 250 $\mu$m and preferably below 150 $\mu$m, for instance 80 or 90% being less than 50 $\mu$m or, in some instances, 100 $\mu$m. The minimum particle size is usually at least 90% by weight above 10 $\mu$m.

The moist mix is formed by blending the particulate mineral with the polymer, the alkali metal compound and any other additives in conventional manner, for instance by mixing with a paddle mixer.

After thorough mixing has been achieved, the moist mix is then pelletised by a tumbling process. By this we mean that the pellets are not formed by extrusion or other compression moulding process but are instead formed by a tumbling action. Typically the pelletisation is conducted using a balling drum or a rotating tilting disc. Pelletisation procedures for forming mineral pellets by these and other conventional tumbling processes are well known and in the invention are usually operated to give a particle size range which is relatively narrow and generally falls somewhere within the range 9–16 mm. For instance as much as, for instance aboe 25% by weight and preferably above 50% is preferably within a range of 2 or 3 mm.

The green pellets are subjected to firing in conventional manner, for instance at a temperature of up to above 1000° C. and typically not more than 1700° C., for instance 1200 to 1500° C. or, preferably, 1250 to 1400° C.

By the invention it is possible to improve pellet growth and size distribution. Instead of or in addition to this it is possible to obtain improved physical properties of the green pellets or of the fired pellets, for instance as indicated by improved dry strength and/or wet strength and/or drop number, compared to the corresponding pellets made with the same binder but with the amount of sodium carbonate and/or silicate being below 150% by weight of the polymer.

The pellets made by the processes of the invention can have superior properties as regards wet strengths and/or dry strengths and or drop number (when tested by the conventional laboratory tests for determining such values) compared to the pellets made in the absence of the large amount of alkali metal silicate.

The invention includes the novel green mineral pellets which are made in the process of the invention. These pellets are formed of mineral particles bonded by binder comprising substantially water soluble organic polymer and alkali metal silicate in an amount as defined above.

The invention also includes fired mineral pellets obtainable by the defined process.

The following are examples of the invention.

EXAMPLE 1

Tests were conducted on a particulate mineral mixture containing magnetite and, as the major component, haematite.

In one set of tests a moist mix was pelletised in conventional manner using about 0.6% bentonite as the binder. The particle size distribution was wide, with only 15.6% by weight of the pellets falling within the preferred size range of 11.2 to 13.2 mm (this value being the average of four tests).

The process was repeated using, as binder, a mixture of 0.0129% sodium carbonate and 0.03% of a polymer of 80% by weight acrylamide and 20% by weight sodium acrylate made in the presence of a small amount of methylene bis acrylamide and having intrinsic viscosity about 6 dl/g, as described in WO93/03190. The moisture content of the mix was 8%. The particle size distribution was again wide, the average of five tests showing 16.3% by weight of the pellets falling within the defined size range.

When this test was repeated but with the addition of 0.46% (dry weight) Waterglass, the particle size distribution was much narrower, with the average of four tests showing 49.4% by weight of the particles within the defined size range.

EXAMPLE 2

A series of tests were conducted using the same 0.0129% sodium carbonate 0.03% polymer binder as in Example 1 and a particulate magnetite concentrate having a moisture content of 9.65%. The effect of adding different amounts of sodium silicate (in the form of metasilicate powder) on the proportion of the pellets in the defined size fraction and on the wet and dry strengths and drop numbers of the resultant pellets is shown in the following table, the tests marked * were conducted in the absence of binder.

| Sodium Silicate dose (%) | % In Required Size Fraction | Average Strength (kg) Wet | Average Strength (kg) Dry | Drop No. | Moisture Content of Mix % |
|---|---|---|---|---|---|
| 0 | 7.1 | 1.29 | 0.64 | 3.0 | 9.5 |
| 0.0975 | 9.3 | 1.79 | 1.89 | 12.2 | 9.2 |
| 0.195 | 35.5 | 1.79 | 1.48 | 11.6 | 8.9 |
| 0.390 | 26.6 | 2.02 | 1.46 | 9.2 | 8.4 |
| 0.780 | 27.7 | 2.05 | 2.71 | 9.7 | 8.6 |
| 0.195* | 12.4 | 1.76 | 0.73 | 3.1 | 9.6 |
| 0.78* | 8.1 | 1.86 | 2.58 | 3.3 | 9.3 |

EXAMPLE 3

Two tests were conducted on a magnetite concentrate containing 9.5% moisture. The magnetite was pelletised using, as binder, 0.0129% sodium carbonate, 0.09% sodium silicate and 0.03% of a polymer of 80% by weight acrylamide and 20% by weight sodium acrylate made in the presence of a small amount of methylene bis acrylamide and having an intrinsic viscosity of about 7 dl/g as described in WO 93/03190. The second test the process was repeated but in the absence of sodium silicate. The effect on particle size distribution, strength characteristics and average pellet drop number are shown in the following table.

| Test | Organic binder dose % | Sodium silicate dose % | % Weight of Pellets Produced −13.5 +11.2 mm | Wet Strength kg | Dry Strength kg | Av. Pellet Drop Number Wet | Av. Pellet Drop Number Dry |
|---|---|---|---|---|---|---|---|
| 1 | 0.03 | 0.09 | 36.5 | 1.67 | 1.35 | 6.3 | 2.0 |
| 2 | 0.03 | 0 | 16.8 | 1.42 | 0.98 | 13.5 | 1.1 |

What is claimed is:

1. A process of making fired mineral pellets by mixing particulate mineral material with moisture and binder comprising substantially water soluble organic polymer to form a moist pelletisable mix, pelletising the moist mix by a tumbling process to form green pellets and firing the green pellets, characterised in that the binder comprises alkali metal silicate in a dry weight amount which is either (a) above 0.13% based on moist mix or (b) above 0.08% based on moist mix and at least three times the dry weight of substantially water soluble organic polymer.

2. A process according to claim 1 in which the amount of the alkali metal silicate is at least 0.18%.

3. A process according to claim 1 in which the amount of the alkali metal silicate is 0.2 to 0.5%.

4. A process according to claim 1 in which the amount of the alkali metal silicate is four to fifteen times the dry weight of the polymer.

5. A process according to claim 1 in which the alkali metal silicate is selected from sodium metasilicate and Waterglass.

6. A process according to claim 1 in which the alkali metal silicate is added as powder.

7. A process according to claim 1 in which the polymer is added as powder and the moisture content of the moist mix is 5 to 15%.

8. A process according to claim 1 in which the polymer is selected from cellulosic polymers, starch polymers, gums, and anionic or cationic polymers of water soluble ethylenically unsaturated monomer or monomer blend.

9. A process according to claim 1 in which the polymer is formed from 10 to 50% by weight sodium acrylate or methacrylate and 50 to 90% by weight acrylamide.

10. A process according to claim 1 in which the particulate mineral is particulate iron ore.

11. A process according to claim 1 in which the particulate mineral material has a particle size at least 90% by weight below 250 $\mu$m.

12. Green mineral pellets formed of mineral particles bonded by binder comprising substantially water soluble organic polymer and alkali metal silicate in a dry weight which is either (a) above 0.13% based on the pellets or (b) above 0.08% by weight based on the pellets and at least three times the dry weight of the substantially water soluble organic polymer.

13. Fired mineral pellets obtained by a process according to claim 1.

* * * * *